US006943684B2

(12) United States Patent
Berry

(10) Patent No.: US 6,943,684 B2
(45) **Date of Patent: *Sep. 13, 2005**

(54) METHOD FOR IDENTIFYING CHEMICAL, BIOLOGICAL AND NUCLEAR ATTACKS OR HAZARDS

(76) Inventor: Kenneth M. Berry, 125 Maple Ave., Wellsville, NY (US) 14895

( * ) Notice: Subject to any disclaimer, the term of this patent is extended or adjusted under 35 U.S.C. 154(b) by 0 days.

This patent is subject to a terminal disclaimer.

(21) Appl. No.: 10/716,211

(22) Filed: Nov. 18, 2003

(65) Prior Publication Data

US 2004/0239500 A1 Dec. 2, 2004

Related U.S. Application Data

(63) Continuation of application No. 09/964,487, filed on Sep. 28, 2001, now Pat. No. 6,710,711.
(60) Provisional application No. 60/236,730, filed on Oct. 2, 2000.

(51) Int. Cl.[7] ..... G08B 21/00
(52) U.S. Cl. ..... 340/540; 340/573.1; 703/11; 703/12
(58) Field of Search ..... 340/540, 573.1, 340/999; 703/6, 11, 12, 13, 22; 434/11

(56) References Cited

U.S. PATENT DOCUMENTS

| | | | | |
|---|---|---|---|---|
| 4,752,226 | A | 6/1988 | Akers et al. | |
| 4,816,208 | A | 3/1989 | Woods et al. | |
| 5,278,539 | A | 1/1994 | Lauterbach et al. | |
| 5,576,952 | A | 11/1996 | Stutman et al. | |
| 5,682,882 | A | 11/1997 | Lieberman | |
| 5,747,719 | A | 5/1998 | Bottesch | |
| 6,084,510 | A | 7/2000 | Lemelson et al. | |
| 6,254,394 | B1 | 7/2001 | Draper et al. | |
| 6,496,110 | B2 * | 12/2002 | Peterson et al. | 340/573.1 |
| 2001/0027389 | A1 | 10/2001 | Beverina et al. | |

OTHER PUBLICATIONS

Menchi, "Consequences Assessment Tool Set (CATS)", Oak Ridge Inst. for Sci. & Ed. (Armed Forces Radiobiology Research Inst.—Special Publ.), vol. 97, No. 4, p 191–207, 1997.

* cited by examiner

*Primary Examiner*—Thomas Mullen
(74) *Attorney, Agent, or Firm*—Alan G. Towner, Esq.; Pietragallo, Bosick & Gordon

(57) ABSTRACT

A surveillance system and method for identifying chemical, biological or nuclear attacks or hazards occurring within a large area which combines data derived from a modeling and simulation operation with a surveillance data input. The modeling and simulation operation involves continuous periodic runs of multiple scenarios for various biological, chemical and nuclear agents in various concentrations for a given location. Using real time weather data for each location, a model is made in a database of the effect various concentrations of agents would have at that location and this simulated model is processed. The surveillance data input monitors actual human signs and symptoms for the modeled area. This data with real time weather data is compared with the results of modeling and simulation data for the area to determine if a pattern matching that for any modeled agent is present.

19 Claims, 1 Drawing Sheet

METHOD FOR IDENTIFYING CHEMICAL, BIOLOGICAL AND NUCLEAR ATTACKS OR HAZARDS

CROSS-REFERENCE TO RELATED APPLICATION

Figure 1:
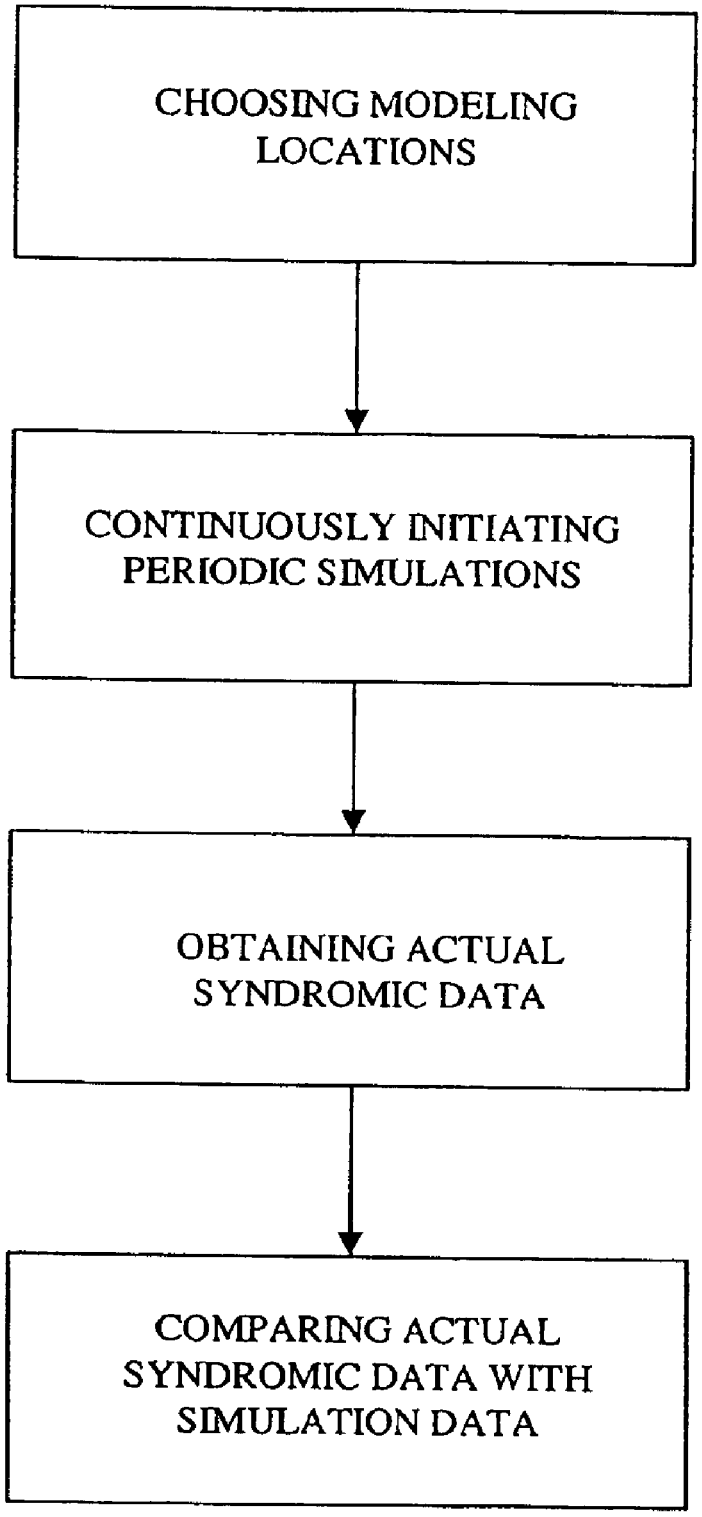

This application is a continuation of U.S. patent application Ser. No. 09/964/487, filed Sep. 28, 2001, now U.S. Pat. No. 6,710,711, which claims priority from U.S. Provisional Application No. 60/236,730, filed Oct. 2, 2000, which are incorporated herein by reference.

BACKGROUND OF THE INVENTION

In an era where chemical, biological or nuclear attacks at one or more locations either globally or within a country are possible, it is desirable to have a surveillance system capable of locating and identifying the type of attack so that a rapid response can be initiated. Such attacks can occur both as a result of enemy or terrorist activity or as a result of a chemical, biological or nuclear accident in a domestic facility. In all such cases, a prompt response with medical treatment will tend to minimize injury and loss of life.

Obviously, sensors exist which will detect various chemical and biological agents as well as nuclear radiation, but effective use of such sensors in a global or even a national surveillance system would require hundreds of thousands of sensors and would be impractical. Also, sensors have been subject to agents devised by microbiologists to thwart the effective operations of the sensors.

Sensors have been effectively used to detect hazardous airborne agent attacks on very limited areas, such as buildings or compounds, but a problem still remains as to how an attack occurring in a large area, such as a city, state, country or globally can effectively and rapidly be identified. To this point, as illustrated by U.S. Pat. No. 5,278,539 to Lauterbach et al., and U.S. Pat. No. 5,576,952 to Stutman et al., hazardous material and medical alerts have originated from small, specific locations or from specific patients.

SUMMARY OF THE INVENTION

It is a primary object of the present invention to provide a novel and improved surveillance system and method for identifying chemical, biological and nuclear/radiological attacks or hazards occurring within a large area too extensive for effective sensor coverage.

Another object of the present invention is to provide a novel and improved surveillance system and method for identifying chemical, biological and nuclear attacks or hazards occurring within a large area which includes obtaining syndromic data from sources within the area and comparing this syndromic data with simulation data modeled for one or more chemical, biological or nuclear agents at a plurality of locations within the area.

A further object of the present invention is to provide a novel and improved surveillance system and method for identifying attacks or hazards caused by chemical, biological or nuclear agents within a large area. A plurality of modeling locations are selected within the area, and spaced periodic simulations are continuously initiated for each modeling location to determine simulation data indicative of symptomatic effects of various concentrations of one or more chemical, nuclear or biological agents at the modeling location. This data is used for comparison with actual syndromic data from sources within the area.

These and other objects are achieved by providing a surveillance system and method for identifying chemical, biological or nuclear attacks or hazards occurring within a large area which combines data derived from a modeling and simulation operation with a surveillance data input. The modeling and simulation operation involves continuous periodic runs of multiple scenarios for various biological, chemical and nuclear agents in varying concentrations for a given location. For example, every two hours for 100 different locations within a city, using real time weather data for each location, a model is made in a database of the effect various concentrations of agents would have at that location and this simulated model is processed in real time and/or stored for future processing.

The surveillance data input monitors actual human signs and symptoms for the modeled area. This real time data can come from monitored clinic and hospital computers, emergency room data, 911 calls, and computer data from pharmacies, physicians and laboratories. This data with real time weather data is compared with the results of modeling and simulation data for the area to determine if a pattern matching that for any modeled agent is present, and if a matching pattern is identified, an alarm is given.

These and other objects are achieved by providing a surveillance system and method for identifying chemical, biological or nuclear attacks or hazards occurring within a large area which combines data derived from a modeling and simulation operation with a surveillance data input. The modeling and simulation operation involves continuous periodic runs of multiple scenarios for various biological, chemical and nuclear agents in varying concentrations for a given location. For example, every two hours for 100 different locations within a city, using real time weather data for each location, a model is made in a database of the effect various concentrations of agents would have at that location and this simulated model is processed in real time and/or stored for future processing.

The surveillance data input monitors actual human signs and symptoms for the modeled area. This real time data can come from monitored clinic and hospital computers, emergency room data, 911 calls, and computer data from pharmacies, physicians and laboratories. This data with real time weather data is compared with the results of modeling and simulation data for the area to determine if a pattern matching that for any modeled agent is present, and if a matching pattern is identified, an alarm is given.

DESCRIPTION OF THE PREFERRED EMBODIMENTS

The present invention provides a method for identifying the presence of an attack on an area by one or more nuclear/radiological, chemical and biological agents. The area involved can be extensive, such as a city, a state, or a nation. The methodology of the invention can be further expanded toward the development of a global surveillance system. Also, a de novo global system can be simultaneously established and integrated. FIG. 1 is a schematic diagram illustrating a method of the present invention. The method includes choosing modeling locations, continuously initiating periodic simulations for each modeling location, obtaining actual syndromic data, and comparing the actual syndromic data with simulation data.

For purposes of description, the invention will be described relative to a city area with the understanding that multiple cities can be similarly involved to provide a state or nationwide system, and nationwide systems can be incorporated into a global system.

Fortunately, a number of data sources exist which if monitored in real time, can provide data which can be combined to provide patterns indicative of the existence of a nuclear, chemical or biological attack. These patterns can be analyzed to show that monitored human injuries or illnesses are more likely to result from a man made attack rather than from natural causes. This analysis can also more effectively preempt the spread of contagious agents, mitigate against the harmful effects of all agents, and provide for improved forensic investigation.

First, the surveillance system needs to monitor human signs and symptoms nationwide. This can be accomplished by a database which would monitor such sources as clinic and hospital computers, emergency room data, 911 emergency data and possibly even computer data from individual physician database accessing and laboratories. This data will identify human diseases, injuries, and symptoms and concentrations of similar signs and symptoms. Using identifications provided by this data, the national census bureau database can be accessed to provide information relative to the residential and work locations for affected individuals and other personal data relative to the possible location of an attack which would result in the monitored signs and/or symptoms.

National weather databases are accessed to obtain data relative to weather patterns in areas where possible attack symptoms have occurred to determine areas where weather borne attack agents have originated or possibly will be found due to dispersement by weather patterns.

All of this data can be correlated and compared with the attributes of the most likely chemical, nuclear and biological agents to determine whether a man made attack scenario is implied. For a statewide or national surveillance system surveillance could be conducted on a city by city basis, and once data analysis implies an attack in one city by a particular agent, other cities can be closely monitored for unusual outbreaks of disease or injury implying an attack by the same agent. Once a national surveillance system is established, individual national surveillance systems can be combined to provide a global surveillance system. Alternatively, a de novo global surveillance system can be simultaneously established and integrated.

The basic method of the present invention involves the use of three interactive components, namely, 1. surveillance data input;
2. modeling and simulation/artificial intelligence data; and
3. pattern analysis and recognition.

By developing and integrating each of these three components in a comprehensive time-phased manner, near real-time syndromic surveillance becomes possible. The continuous operation and interaction of these three components makes early attack detection feasible.

A significant component of the method of the present invention is forward deployed modeling and simulation applications involving continuous periodic runs of multiple scenarios of various attack agents in varying concentrations at multiple locations in a surveillance area. Using a city as an example, continuous multiple runs of point and line sources of multiple chemical and/or biological agents of varying concentrations are periodically run for potential strategic locations within the city. Such locations could include mass transit systems, rivers, harbors, known hazmat sources and locations, mass gathering locations and symbolic cultural entities and events. Each time a run is made for a location, up to date weather information is received for that location to use in simulating a pattern of concern for that location. Thus by running a simulation of multiple agents at multiple concentrations for multiple locations in a given city and doing so frequently, such as every two hours, tested and proven models can be developed to provide knowledge of patterns of concern. For example, forty agents that would be run in an HPAC or other model every two hours at one hundred locations in a given city would provide patterns of respective attacks in that city at a given time. These simulated patterns are processed in real time and/or stored to provide a basis for comparison with actual syndromic surveillance data developed from the surveillance data input component.

There are a number of known, state of the art modeling and simulation systems which permit a user to simulate technological hazards and assess the effects thereof on the affected population. These systems use terrain, urban parameters and real time weather information and a software package to generate a simulation of various concentrations of biological or chemical agents and distributions of radiation intensities to obtain a calculation of the consequence of the hazardous agents to a segment of the population. Wind and terrain data and urban parameters for the area involved in the simulation permits the development of a definite pattern for each concentration of the simulated hazardous agent, as the dispersion of the agent is dependent upon terrain and existing weather conditions.

Each agent has specific signs or symptoms and time of onset and area of distribution (location) depending on:

1. how applied, i.e., point source or line source
2. concentration
3. weather (wind, etc.)

This is like a fingerprint and multiple fingerprints can be modeled and processed in real time and/or stored.

Among the known modeling and simulation systems which can be used to effectively provide the modeling and simulation component of the present invention are Hazard Predictions and Assessment (HPAC) prepared by Defense Threat Reduction Agency and Science Applications International Corporation of San Diego, Calif. and Consequences Assessment Tool Set (CATS) prepared by Science Applications International Corporation.

A second significant component of the method of the present invention is the development of actual surveillance data to help ascertain any abnormal early pattern of syndromic data which may result from unnatural nuclear, biological or chemical conditions. Since it is unrealistic to provide effective sensor surveillance of large areas, the present method derives data from unconventional and conventional existing data sources in accordance with a time-phased data acquisition methodology. These data sources provide syndromic data from local communities as to what signs and symptoms are occurring early and where they are occurring. Subsequently, this data indicates what further signs and symptom development timeline occurs.

Sources of data for the surveillance data input component could include non-traditional and traditional data sources and could be divided into initial and early sub components. The initial sub component category could include (in countries where it would be legal) electronic surveillance of general phone calls from the general public involving language dealing with symptoms and signs and other syndromic surveillance information. Resources such as ESCHELON and other similar systems could assist in this component. Such systems could be adapted to recognize syndromic information (i.e., cough or wheezing etc.). Also, the initial nontraditional data sources would include surveillance of pharmacy sales of anti fever, anti cough, anti rash, anti diarrhea etc. over the counter medicines which could be surveyed in real time with proper coordination. There are a relatively small number of major pharmacy chains in the United States, so their computers could be easily monitored to determine when their supplies of various medicines for treatment of the effects of certain hazardous agents are being rapidly depleted in specific geographic locations.

Another such approach could include monitoring of sentinel physician office calls and calls to emergency departments. Incoming calls to HMO's and Insurance Company managed care screening call systems, which happen to be located mostly in populated areas would also be monitored, and a significant increase in calls over the number normal for an area would be noted as indicative of an abnormal situation.

In the early sub category, actual visits to sentinel physicians' offices would be monitored. This could be done, for example, with electronic telemetric light templates prepositioned that would centrally communicate an array of presenting symptomatology and geographic distribution of that symptomatology. Also, actual emergency department visits could be monitored in this way as well as 911 and EMS calls. These could provide an indication of the occurrence of similar symptoms in a particular geographical location such as city quadrant. Other approaches could also be utilized here as well as other traditional data sources for these aggressive categories.

Thus, in accordance with the time-phased methodology of the present invention, the initial syndromic surveillance data is the first data received followed by data in the early category. These sources break down as follows:

| Initial | Early |
|---|---|
| General public telecommunications monitoring (where legal) | Sentinel physician office chief complaint & sign in monitoring |
| Targeted pharmacy sales of syndromically related OTC meds | 911 & EMS systems monitoring |
| Sentinel physician office telecommunications monitoring | Sentinel Emergency Department chief complaint & sign-in monitoring |
| Sentinel Emergency Department telecommunications monitoring | |
| Monitoring of HMO & insurance company managed care screening call systems | |

In addition to the initial syndromic surveillance data, available census, geographical and weather databases are initially accessed. The use of nighttime census data and possibly daytime mobile population databases will help determine the identity and location of victims for early treatment. The utilization of geographical information databases interfaced with historical, actual real-time, forecasted and other weather data superimposed on census and population data models can help ascertain any abnormal early pattern recognition of the primary syndromic surveillance data as would be seen in a manmade unnatural nuclear, biological or chemical (NBC) attack.

Subsequent to the receipt of the initial and early syndromic surveillance data and the census, geographical and weather data, traditional data sources can be monitored to provide delayed medical data and delayed intelligence data to augment the initial and early syndromic surveillance data. These traditional data sources may include the following:

| A. Secondary (Delayed) Medical Data Input(s) | Secondary (Delayed) Intelligence Data Input(s) |
|---|---|
| 1. Lab Data | Other epidemiological data (i.e., dead crows) |
| 2. Xray Data | Other Intel data (i.e., CDC smallpox samples stolen prior) |
| 3. Follow-up reexaminations | |
| Death Certificates (accounting & assessment) | |
| Autopsy results | |

This later data from the traditional data sources is collated with the earlier syndromic surveillance data to further develop a signature of what occurred in the large area from which the data was collected.

The final component of the method of the present invention is the correlation of a signature pattern developed from the earlier syndromic surveillance data, and in some instances the traditional data with a simulated pattern or patterns processed in real time or stored from the forward deployed modeling and simulation component. This involves the use of artificial intelligence software to determine whether or not a signature similar to one processed in real time or stored from the forward deployed modeling and simulation component is present and the generation of an alarm when such presence is sensed.

The forward deployed modeling and simulation component develops definite specific signature patterns (and probabilistic ranges thereof) relating to human symptoms resulting from various levels of biological and chemical agents and radiation under existing weather conditions. By collectively gathering and analyzing actual surveillance data with relation to existing weather conditions, very definite signature patterns relating to existing human symptoms can be developed for comparison with simulated processed real time and stored signature patterns. This data will provide the basis of disease specific fingerprints which will eventually provide reliable predictive data and hence preemptive data. While this approach focuses on infrequent, high threat, high impact events and agents, it is also necessary to simultaneously maintain an awareness of general disease trends to properly understand the background (noise) data so as to better interpret the superimposed spikes of new data acquired by the actual surveillance component.

By further developing and integrating each of the above components in a comprehensive time-phased manner, near real-time syndromic surveillance becomes a distinct possibility and hence protection from biological attack a closer reality. Initially, this method must focus on the most significant threat agents (i.e., biological weapon inhalational agents), but other biological disease threats must eventually be included. These include communicable disease threats from other airborne, waterborne, foodborne, and insect-borne (i.e., mosquito, tick, flea, etc.) disease sources also including an array of zoonotic diseases (animal diseases which can cross over and cause human disease). Since bio-terrorism can also be directed specifically against animal and plant populations, the method can include surveillance of these populations.

What is claimed is:

1. A method for identifying the presence of an attack on an area by one or more nuclear, chemical and biological agents which includes:

choosing one or more modeling locations within the area for modeling scenarios for one or more chemical, biological or nuclear agents;

performing simulations for the modeling locations to determine simulation data indicative of the symptomatic effects of one or more concentrations of one or more chemical, nuclear or biological agents at the modeling locations;

obtaining actual syndromic data comprising human signs and/or human symptoms from data sources within said area; and comparing said actual syndromic data with simulation data to determine the existence or nonexistence of correlation therebetween.

2. The method in accordance with claim 1 which includes providing an alarm indication when correlation between the actual syndromic data and the simulation data is detected.

3. The method in accordance with claim 1 which includes obtaining weather data for weather existing at each modeling location at the time of each simulation and using such weather data with the one or more concentrations of chemical, nuclear or biological agents to determine the simulation data for such simulation.

4. The method in accordance with claim 3 which includes obtaining area weather data for weather existing in the area from which said actual syndromic data is obtained and using such area weather data with the actual syndromic data in the determination of the existence or nonexistence of correlation with the simulation data.

5. The method in accordance with claim 4 which includes providing an alarm indication when correlation between the actual syndromic data and the simulation data is detected.

6. The method in accordance with claim 1 wherein each simulation includes determining the symptomatic effects of each concentration of said chemical, nuclear or biological agents and the time of onset of each symptomatic effect.

7. The method in accordance with claim 6 which includes obtaining actual syndromic data from data sources within said area over a data development timeline and integrating the actual syndromic data in a time-phased manner for comparison with said simulation data to determine whether or not a correlation exists between symptomatic effects and times of onset thereof.

8. The method in accordance with claim 7 which includes obtaining census data and/or mobile population data from data sources for said area to use in determining the identity and location of victims for treatment when said actual syndromic data correlates with said simulation data.

9. The method in accordance with claim 7 wherein said actual syndromic data initially includes initial data relating to one or more of telecommunications monitoring, pharmacy medication sales and locations and HMO and insurance company managed care screening call systems.

10. The method in accordance with claim 9 wherein said initial data relating to telecommunications monitoring includes one or more of general public telecommunications, physicians' office telecommunications, and emergency department telecommunications.

11. The method in accordance with claim 9 wherein subsequent to said initial data and in accordance with said data development timeline, said actual syndromic data includes early data derived from one or more of physicians' office complaint and sign in monitoring, 911 and emergency system monitoring, and emergency department complaint and sign in monitoring.

12. The method in accordance with claim 11 wherein subsequent to said initial and early data and in accordance with said data development timeline, said actual syndromic data includes delayed medical data and delayed intelligence data.

13. The method in accordance with claim 12 wherein delayed medical data includes one or more of medical laboratory data, x-ray data, follow-up reexamination data, death certificate data and autopsy data.

14. The method in accordance with claim 13 wherein said delayed intelligence data includes epidemiological data and intelligence data relative to the disappearance of nuclear, chemical or biological hazardous materials.

15. The method in accordance with claim 1 wherein each simulation includes determining the probabilistic range of symptomatic effects for each concentration of chemical, nuclear or biological agents for a given population under given meteorological conditions.

16. A method for identifying the presence of an attack on an area by one or more nuclear, chemical and biological agents which includes:

choosing one or more modeling locations within the area for modeling scenarios for one or more chemical, biological or nuclear agents;

performing simulations for the modeling locations to determine simulation data indicative of the symptomatic effects of one or more concentrations of one or more chemical, nuclear or biological agents at the modeling locations;

obtaining actual syndromic data from data sources within said area; and comparing said actual syndromic data with simulation data to determine the existence or nonexistence of correlation therebetween, wherein each simulation includes determining the symptomatic effects of each concentration of said chemical, nuclear or biological agents and the time of onset of each symptomatic effect.

17. The method in accordance with claim 16 wherein the actual syndromic data comprises human signs and/or human symptoms.

18. A method for identifying the presence of an attack on an area by one or more nuclear, chemical and biological agents which includes:

choosing one or more modeling locations within the area for modeling scenarios for one or more chemical, biological or nuclear agents;

performing simulations for the modeling locations to determine simulation data indicative of the symptomatic effects of one or more concentrations of one or more chemical, nuclear or biological agents at the modeling locations;

obtaining actual syndromic data from data sources within said area; and comparing said actual syndromic data with simulation data to determine the existence or nonexistence of correlation therebetween, wherein each simulation includes determining the probabilistic range of symptomatic effects for each concentration of chemical, nuclear or biological agents for a given population under given meteorological conditions.

19. The method in accordance with claim 18, wherein the actual syndromic data comprises human signs and/or human symptoms.

* * * * *